United States Patent [19]

Saurwein

[11] Patent Number: 4,545,157

[45] Date of Patent: Oct. 8, 1985

[54] CENTER FEEDING WATER JET/ABRASIVE CUTTING NOZZLE ASSEMBLY

[75] Inventor: Albert C. Saurwein, Auburn, Wash.

[73] Assignee: McCartney Manufacturing Company, Baxter Springs, Kans.

[21] Appl. No.: 541,826

[22] Filed: Oct. 18, 1983

[51] Int. Cl.[4] ..... B24C 5/04

[52] U.S. Cl. ..... 51/439; 239/430; 239/433

[58] Field of Search ..... 51/439, 319–321, 51/410; 239/428, 430, 433, 429

[56] References Cited

U.S. PATENT DOCUMENTS

| | | | |
|---|---|---|---|
| 3,424,386 | 1/1969 | Maasberg et al. | 239/433 |
| 3,612,405 | 10/1971 | Heinrich | 239/433 |
| 4,080,762 | 3/1978 | Watson | 51/439 |
| 4,449,332 | 5/1984 | Griffiths | 51/439 |
| 4,478,368 | 10/1984 | Yie | 51/439 |

*Primary Examiner*—Frederick R. Schmidt
*Assistant Examiner*—Robert A. Rose
*Attorney, Agent, or Firm*—Bernard J. Murphy

[57] ABSTRACT

A nozzle for use in water jet cutting includes distinct upper and lower bodies held together by a locking device. The upper and lower bodies each include a mating surface, the two mating surfaces being of complementary shape and held in close contact by the locking device. The upper body includes a fluid inlet and a plurality of fluid outlets. The lower body includes a mixing chamber and the fluid outlets are in fluid communication with the mixing chamber. A jewel having a stream-forming aperture formed therethrough is mounted in each of the fluid outlets and arranged so that the centerlines of the stream-forming apertures converge to a focal point within the mixing chamber. The nozzle includes a nozzle exit passage having a first end in fluid communication with the mixing chamber, the focal point of the centerlines being adjacent the first end of the nozzle exit passage. The upper body includes an abrasive inlet connected to an abrasive passage that opens into the mixing chamber. The abrasive passage is coaxial with the nozzle exit passage. Preferably, a distinct sealing device is associated with each of the jewels to form a seal between the jewel and the upper and lower bodies to prevent leakage of fluid from between the mating surfaces. Preferably, the upper and lower bodies are generally cylindrical and coaxial and the jewels are mounted on a circle whose center is the axis of the upper and lower bodies.

3 Claims, 4 Drawing Figures

Fig. 1.
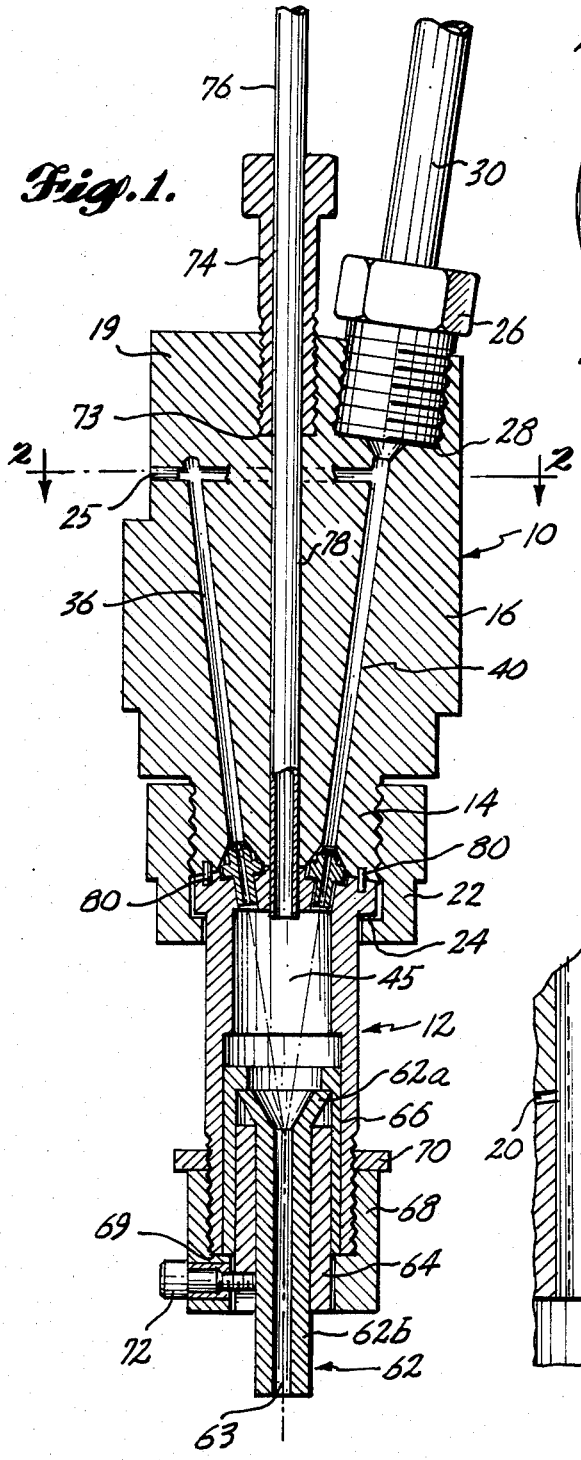
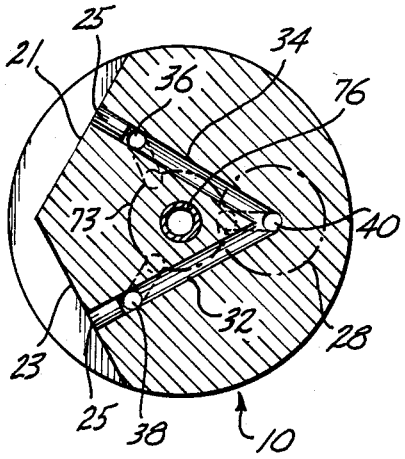
Fig. 2.
Fig. 3.
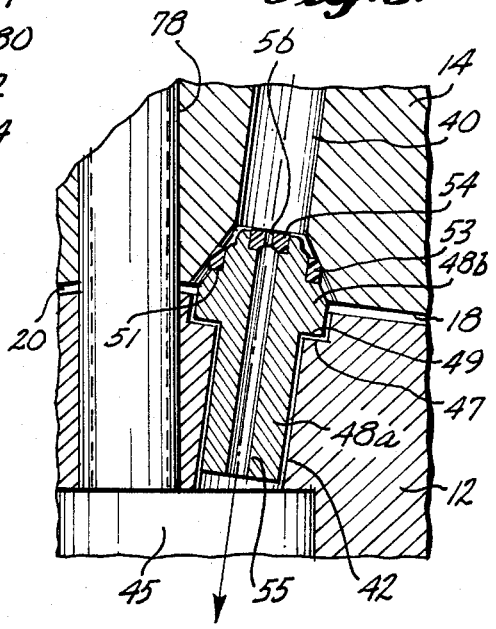

CENTER FEEDING WATER JET/ABRASIVE CUTTING NOZZLE ASSEMBLY

BACKGROUND OF THE INVENTION

This invention relates to water jet cutting nozzles and, in particular, relates to a nozzle having a top center feed for abrasive material and two or more fluid orifices.

It is known in the prior art to provide a nozzle assembly that receives high-pressure fluid, typically water, from an intensifier pump and has an exit orifice of small diameter to form a very thin high-pressure stream of fluid, which can be used to cut materials such as concrete and asphalt. It is also known in the prior art to introduce into the nozzle a supply of an abrasive material that is then entrained into the fluid stream exiting the nozzle to enhance the cutting action of the fluid stream. With the addition of abrasive to the fluid stream, the nozzle could even be used to cut metals. In prior art nozzles the abrasive material is introduced laterally into the fluid stream in a mixing chamber that suffers a very high rate of wear due to the bombardment of the interior of the mixing chamber walls by the abrasive material prior to and during its entrainment into the fluid stream. Also, the introduction of the abrasive into the fluid stream transverse to the fluid flow makes for a less than complete entrainment of the abrasive into the fluid stream. Because of the incomplete entrainment of the abrasive into the stream, a significant amount of the abrasive is carried on the exterior of the fluid stream and comes into contact with the walls surrounding the exit opening of the nozzle, thereby causing abrasive wear to those walls.

Some prior art water jet cutting nozzles contain jewels having a small passageway formed through them that forms the thin water stream. It is known to provide a two-piece nozzle body with the jewels mounted in one of the pieces. Typically, in the design of multiple orifice abrasive nozzles the jewels have been inserted in a single small plate and fed from a single conduit that seals the exterior of the jewel plate. In such an arrangement the abrasive must be introduced laterally into the stream downstream from the jewels. Attempts have been made to mount the jewels in an annular plate and to seal both the inner and outer periphery of the annulus and feed the high-pressure water into the annulus. The center area bounded by the annulus is then left open for an abrasive feed hole. This configuration is largely unused because of the loss of center support structure to react to the high load produced by the fluid pressure on the exposed annulus.

It is therefore an object of the present invention to provide a water jet cutting nozzle that accepts high-pressure fluid and forms the fluid into a thin exit stream and also accepts an abrasive material that is entrained and that minimizes wear at the point of mixing of the fluid and abrasive.

It is a further object of this invention to provide such a water jet cutting nozzle in which the abrasive is more fully entrained into the fluid stream and in which the contact between the abrasive and the sidewalls surrounding the exit opening of the nozzle is minimized.

It is another object of this invention to provide such a water jet cutting nozzle that can be effectively sealed against the high pressures of fluid encountered in hydraulic cutting equipment.

SUMMARY OF THE INVENTION

In accordance with the above-stated objects, a nozzle for use in water jet/abrasive cutting includes an upper body having a lower mating surface and a lower body having an upper mating surface. The upper and lower bodies are held together by a locking means such that the mating surfaces are held in close contact. The upper body includes an inlet for an abrasive material and an outlet for the material. The abrasive inlet and outlet are connected by a conduit formed within the upper body. The upper body also includes a fluid inlet and at least two fluid outlets that are formed in the upper body in the lower mating surface. A manifold is formed within the upper body, and is in fluid communication with the fluid inlet and both fluid outlets to conduct high-pressure fluid entering the upper body through the upper body to the fluid outlets. The lower body has a mixing chamber formed within it and includes at least two jewel-mount orifices formed in the upper mating surface of the lower body so as to be in fluid communication with the mixing chamber. An abrasive orifice is also formed in the upper mating surface and is in fluid communication with the mixing chamber at a point intermediate the jewel-mount orifices. First and second jewels are mounted, respectively, in the two jewel-mount orifices. Each of the jewels has a stream-forming aperture formed through it that is in fluid communication with the jewel-mount orifice and the fluid outlets of the upper body. The nozzle includes nozzle exit means mounted in the lower body. The nozzle exit means includes an exit passageway in fluid communication with the mixing chamber. The jewels are oriented with respect to the upper mating surface so that the centerlines of the stream-forming apertures in said jewels converge and focus at a point within the mixing chamber adjacent the nozzle exit means. Preferably, the nozzle exit means is movably mounted in the lower body for movement in a direction orthogonal to the upper mating surface. Preferably, the nozzle assembly includes a locking means associated with the nozzle exit means and operable to hold the nozzle exit means in position within said lower body.

In the preferred embodiment, each of the jewels is affixed to a jewel mount that is mounted in one of the respective jewel-mount orifices. The nozzle assembly of the present invention preferably also includes a plurality of sealing means interposed between each of the jewel mounts and the lower mating surface to form a high-pressure seal to prevent leakage of fluid from between the upper and lower mating surfaces.

In the preferred embodiment, three jewels are used located on a circle whose center is the axis of the upper and lower bodies. The manifold formed in the upper body separates the inlet stream of fluid into three separate streams arranged concentrically about the abrasive conduit which is coincident with the axis of the upper and lower bodies. The three jewels mounted in the upper mating surface of the lower body form three streams of fluid entering the mixing chamber that converge at a focal point within the mixing chamber. The abrasive enters the mixing chamber in the center of the three streams and contacts the three streams substantially simultaneously at their focal point. The nozzle exit means preferably includes a cone portion within the mixing chamber and the nozzle exit means position is adjusted such that the focal point of the three streams formed by the three jewels is closely adjacent the apex of such conical portion, the apex of the conical portion forms a first end of the exit passageway through the nozzle exit means.

BRIEF DESCRIPTION OF THE DRAWINGS

The objects and advantages of the present invention will be better understood by those of ordinary skill in the art and others upon reading the ensuing specification taken in conjunction with the appended drawings wherein:

FIG. 1 is a side elevational view with a portion cut away of one embodiment of a nozzle assembly made in accordance with the principles of the present invention;

FIG. 2 is a plan view along line 2—2 of FIG. 1 of a portion of the upper body of the nozzle assembly of FIG. 1 showing the manifold configuration;

FIG. 3 is a detailed view in expanded scale of a portion of the nozzle assembly of FIG. 1 showing the jewel and jewel-mount.

DETAILED DESCRIPTION OF THE PREFERRED EMBODIMENT

Figure 4:
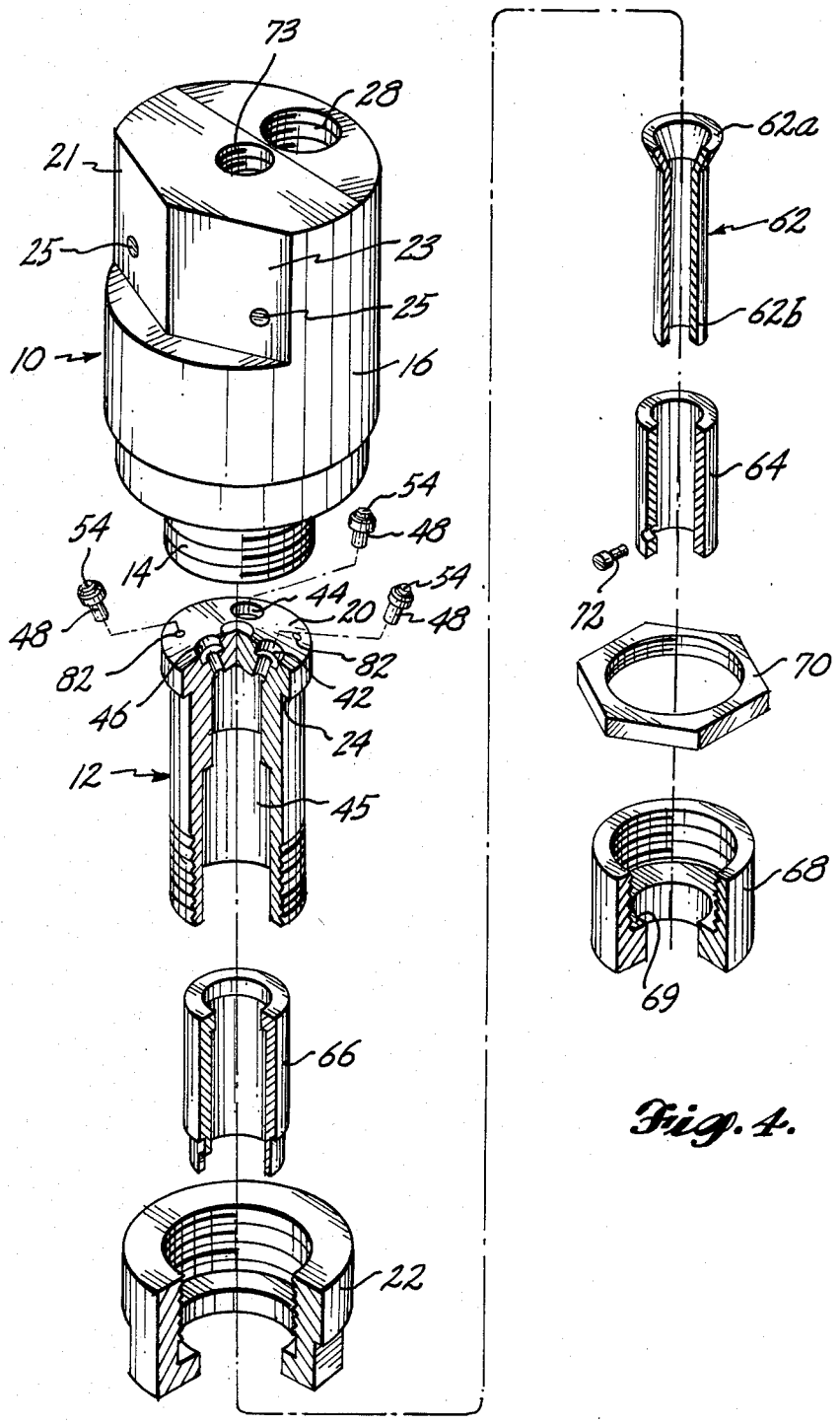
FIG. 4 is an exploded isometric view of the nozzle assembly of FIG. 1 showing the individual nozzle pieces.

A preferred embodiment of a nozzle suitable for use in water jet/abrasive cutting and made in accordance with the principles of the present invention is shown in FIG. 1. FIG. 1 is a side elevational view in cross section of the nozzle assembly, which includes a substantially cylindrical upper body 10 and a substantially cylindrical lower body 12. The upper body 10 has a threaded projection 14 extending downwardly from the main portion 16 of the upper body. A lower mating surface 18 of the projection 14 is concave and mates with a convex upper mating surface 20 of the lower body 12. The upper and lower bodies are held in abutment by means of a threaded collar 22 that engages a shoulder 24 of the lower body and is threadably engaged to the threaded projection 14. A fluid connector 26 threadably engages an inlet opening 28 formed in the upper body 10 and couples fluid line 30 from a source of high-pressure fluid (not shown) to the fluid inlet 28. The fluid inlet 28 is in fluid communication with a manifold assembly formed within the upper body 10. The manifold assembly can best be seen in FIG. 2 and includes a first transverse passageway 32 and a second transverse passageway 34, both in fluid communication with the fluid inlet 28. The transverse passageways split the stream from the fluid inlet 28 and route it to longitudinal passageways 36, 38, and 40 formed within the upper body. The upper ends of the passageways 36, 38, and 40 are arranged on the circumference of a circle having its center coincident with the axis of the upper body. The passageways 36, 38, and 40 converge toward one another as they pass through the upper body and terminate in countersunk fluid orifices formed in the lower mating surface 18. An upper portion 19 of the upper body has a section cut away to form flat sides 21 and 23. The transverse passageway 32 and 34 are formed by boring holes into the upper portion through the flat sides 21 and 23. The ends of the bores opening to the flat sides are plugged by plugs 25 to channel the fluid into the longitudinal passageways 36 and 38. The manifold and passageways function to conduct fluid entering from the high-pressure fluid source through the fluid inlet 28 into three separate paths along the longitudinal passageways 36, 38, and 40.

Jewel-mounting orifices 42, 44, and 46 are formed in the upper mating surface 20 of the lower body 12 and extend into a cylindrical mixing chamber 45 formed within the lower body. Each of the jewel-mount orifices receives a jewel mount 48. The jewel mount 48 is best seen in FIG. 3 and has a cylindrical lower portion **48*a* that is of slightly smaller diameter than the jewel-mount orifice. A larger diameter upper portion 48*b* of the jewel mount forms a shoulder 49 that rests on a ledge 46 formed by the jewel-mount orifice. The upper portion 48*b* of the jewel mount is generally frustoconical. A portion of the core is removed to form a ledge 51 upon which rests an annular sealing ring 53 of rectangular cross section. The jewel mount 48 has an axial center bore 55 formed therethrough. The upper end of the center bore is of larger diameter and a cylindrically shaped jewel 54 is mounted therein. The jewel is fastened in the bore by a permanent adhesive such as locktite. The jewel 54 has a stream-forming orifice 56 formed therethrough such that fluid communication is maintained between the passageway 40, the center bore 55 of the jewel mount 48, and the mixing chamber 45. The jewel 54 can be any suitable jewel as found in the prior art utilized to form a thin stream of fluid such as the sapphire jewels used in water jet cutting nozzles. The jewel mounts 48 are identical and are mounted in their respective jewel-mounting orifices 42, 44 and 46** such that the streams formed by the jewel stream-forming orifices converge to a focal point within the mixing chamber.

Referring again to FIG. 3, the end of the passageway 40 adjacent the lower mating surface 18 of the upper body 10 is countersunk to a frustoconical shape that closely conforms to the exterior shape of the jewel mount upper portion **48*b*. The seal ring 53 is preferably of a deformable material that fills any gaps or spaces between the jewel mount 48 and the countersunk portion of the passageway 40 when the upper and lower body portions are axially compressed together by the lock nut 22. An identical sealing member is associated with each of the jewel mounts to form a high-pressure seal between the upper and lower body of the nozzle assembly. The upper portion of the jewel mount has a slight inverse curvature to ensure that the walls of the jewel mount 48 immediately surrounding the jewel 54 do not contact the walls of the passageway 40**. In this way no radial force is exerted on the jewel that may tend to crush it.

A nozzle exit means 62 is mounted within the mixing chamber 45 and has an upper portion **62*a* of frustoconical shape and a lower cylindrical portion 62*b* extending therefrom beyond the lower body 12. A conical bore is formed within the upper portion of the nozzle exit means with the apex of the bore forming the upper ends of a nozzle exit passageway 63 bored through the center of the cylindrical portion 62*b*. The nozzle exit means is positioned within the mixing chamber such that the focal point of the streams formed by the three jewels is closely adjacent the apex of the frustoconical portion. The exit means 62 is surrounded by an inner sleeve 64 that is intermediate the exterior of the nozzle means 62 and an outer sleeve 66 that closely fits within the walls of the mixing chamber 45. A threaded cap 68 threadably engages a threaded lower portion of the lower body 12 and has a shoulder 69 that engages the bottom edges of the inner and outer sleeves 64 and 66 to hold them in place within the lower body. A lock nut 70 is threaded onto the lower body above the cap 68 and forms a stop for the cap 68. By adjustment of the lock nut 70 and lower cap 68, the axial position of the nozzle exit means within the mixing chamber 12 may be adjusted to correctly align the conical portion of the exit means with the focal point of the liquid streams. A set screw 72 passes through the cap 68 and the sidewalls of the inner and outer sleeves 64 and 66 such that the end of the set screw engages the side of the cylindrical portion 62***b* of the nozzle exit means. The set screw 72 threadably engages the sleeves and can be tightened to lock the nozzle exit means into position so that it is not moved axially by the forces of the fluid streams within the nozzle assembly.

The upper body 10 has an abrasive inlet bore 73 formed therein. A threaded coupling 74 threadably engages the abrasive inlet and an abrasive feed conduit 76 is mounted within the coupling 74 to feed abrasive from a source (not shown) into the abrasive inlet of the upper body 10. An abrasive feed passageway is formed within the upper body in communication with the abrasive inlet and exits the upper body at the lower mating surface 18, where it mates with another passageway formed in the upper mating surface 20 of the lower body 12 and extending through the lower body into the mixing chamber 45. A tube 78 is inserted into the passageway to feed abrasive material from the inlet bore 73 to the mixing chamber along the center axis of the upper and lower bodies of the nozzle assembly. The abrasive material meets the fluid streams formed by the jewels at the point of convergence of the streams and becomes entrained in the exit stream leaving the nozzle exit means 62.

The introduction of the abrasive axially into the stream enables more complete entrainment of the abrasive into the fluid stream exiting the nozzle assembly since there is no change of direction of the abrasive from its entry into the mixing chamber to its exit from the nozzle. Since the abrasive is surrounded by streams formed by the jewels, little if any of the abrasive contacts the inner walls of the mixing chamber, thereby substantially reducing wear on the inner walls of the mixing chamber. Since the entrainment of the abrasive into the fluid stream is essentially complete, the abrasive does not contact the walls surrounding the bore 63 or the end of the nozzle exit means, thereby reducing wear on the nozzle exit means. The adjustability of the nozzle exit means with relation to the focal point of the stream permits the mixing of the abrasive and the fluid to occur in open space out of contact with any of the nozzle parts so that wear is minimized.

The upper and lower bodies are compressively held together by the reaction of the lock nut 22 such that the mating forces between the upper and lower body portions are in an axial direction. The lack of rotational torque on the mating surfaces permits use of the jewel-mounting arrangement described and illustrated with individual sealing members associated with each of the jewels and jewel mounts to provide a suitable high-pressure seal against fluid leakage. In order to prevent rotational motion of the upper and lower body portions with respect to one another during tightening of the lock nut, retaining pins 80 can be inserted into the lower mating surface 18 of the upper body to engage matching holes 82 in the upper mating surface 20 of the lower body to react against any torque transferred from the lock nut to the body.

While a preferred embodiment of the nozzle assembly of the present invention has been described and illustrated, it will be understood by those of ordinary skill in the art and others that several modifications can be made to the various parts of the nozzle assembly while remaining within the scope of the present invention. For example, while the preferred embodiment of the nozzle assembly has been described as having three jewels forming three converging fluid streams in the mixing chamber, the principles of the present invention will work with the nozzle having two jewels or more than three jewels arranged about a center abrasive feed. Further, the shape of the jewel mount described is preferred but not critical to the invention. The sealing members that lie between the jewel mount and the upper body can be made of any suitable deformable material, such as soft metal, e.g., copper, or a plastic material, such as Delrin or nylon. Since changes can be made in the described embodiment of the nozzle assembly while still conforming to the principles of the present invention, the invention should be defined solely by reference to the appended claims.

The embodiments of the invention in which an exclusive property or privilege is claimed are defined as follows:

1. A nozzle assembly for use in abrasive cutting, comprising:

an upper body which has an abrasive inlet and abrasive outlet formed in said upper body, and an abrasive conduit joining said abrasive inlet to said abrasive outlet within said upper body;

a fluid inlet formed in said upper body;

a plurality of fluid outlets formed in said upper body surrounding said abrasive outlet;

a manifold formed in said upper body in fluid communication with said fluid inlet and all of said fluid outlets;

a lower body having a mixing chamber formed therein;

a plurality of jewel-mount orifices formed in said lower body in fluid communication with said mixing chamber, each of said jewel-mount orifices being associated with and in fluid communication with one of said fluid outlets, and an abrasive orifice formed in said lower body in fluid communication with said abrasive outlet and said mixing chamber;

a plurality of jewels, each jewel associated with and mounted in one of said jewel-mount orifices, each of said jewels having a stream-forming aperture formed therethrough in fluid communication with its associated jewel-mount orifice; and nozzle exit means mounted in said lower body, said exit means including an exit passageway in fluid communication with said mixing chamber; wherein said upper and lower bodies are separate structures, said nozzle assembly further including locking means associated with said upper and lower bodies to hold said upper and lower bodies in close contact; and said upper body is substantially cylindrically shaped and has a lower mating surface and said lower body is substantially cylindrically shaped and has an upper mating surface congruent to said lower mating surface of said upper body, said abrasive outlet and said fluid outlets being formed in said lower mating surface and said abrasive orifice and said jewel-mount orifices being formed in said upper mating surface.

2. The abrasive nozzle of claim 1 wherein said locking means includes a locking ring threadably engaging said upper body, said locking ring having a shoulder formed thereon that engages a cooperative shoulder formed on said lower body to exert a compressive force in the axial direction on said upper and lower bodies.

3. The abrasive nozzle of claim 2, further including: a first locking pin inserted into said upper mating surface and engaging a hole in said upper mating surface and a second locking pin radially spaced from said first locking pin mounted in said upper mating surface and engaging a hole formed in said lower mating surface, said locking pin reacting any torque exerted on said upper and lower bodies by said locking ring.

* * * * *